US010940987B2

(12) United States Patent
Carroll

(10) Patent No.: US 10,940,987 B2
(45) Date of Patent: Mar. 9, 2021

(54) INSULATED CARRY BAG

(71) Applicant: Suzanne Joan Carroll, Gisborne (AU)

(72) Inventor: Suzanne Joan Carroll, Gisborne (AU)

( * ) Notice: Subject to any disclaimer, the term of this patent is extended or adjusted under 35 U.S.C. 154(b) by 0 days.

(21) Appl. No.: 16/063,649

(22) PCT Filed: Dec. 16, 2016

(86) PCT No.: PCT/AU2016/000402
§ 371 (c)(1),
(2) Date: Jun. 18, 2018

(87) PCT Pub. No.: WO2017/100824
PCT Pub. Date: Jun. 22, 2017

(65) Prior Publication Data

US 2019/0002185 A1 Jan. 3, 2019

(30) Foreign Application Priority Data

Dec. 18, 2015 (AU) ..... 2015101819

(51) Int. Cl.
*B65D 81/38* (2006.01)
*A45C 3/06* (2006.01)
(Continued)

(52) U.S. Cl.
CPC ..... *B65D 81/3897* (2013.01); *A45C 3/001* (2013.01); *A45C 3/04* (2013.01);
(Continued)

(58) Field of Classification Search
CPC .... B65D 81/3897; B65D 81/00; B65D 81/38; B65D 81/3888; B65D 81/3837;
(Continued)

(56) References Cited

U.S. PATENT DOCUMENTS 4,854,736 A * 8/1989 McVeigh ..... A45C 3/04 383/76
5,361,603 A * 11/1994 Merritt-Munson ..... 62/457.2
(Continued)

FOREIGN PATENT DOCUMENTS

AU 2008100337 A4 5/2008
AU 2010238657 B2 6/2014
(Continued)

OTHER PUBLICATIONS

International Search Report, corresponding to International Application No. PCT/AU2016/000402, dated Jun. 22, 2017 (4 pages).
(Continued)

*Primary Examiner* — Emmanuel E Duke
(74) *Attorney, Agent, or Firm* — Loeb & Loeb LLP

(57) ABSTRACT

The present disclosure relates to a carry bag, the carry bag includes a body having sidewalls and at least one handle disposed on the body. The body is hollow and dimensioned to receive one or more objects that are to be kept either cooler or warmer than the ambient temperature surrounding the body. The sidewalls of the body are constructed from an outer layer that corresponds to an exterior side wall of the body, a heat reflective layer that corresponds with an interior side wall of the body, and an insulative and pliable foam filling disposed between the outer layer and the heat reflective layer. The at least one handle is adapted to swing out of the way when not in use, so that the opening of the bag is unobstructed, thereby allowing the easy placement or removal of items to/from the bag.

16 Claims, 9 Drawing Sheets

(51) Int. Cl.

| | |
|---|---|
| ***A45C 11/20*** | (2006.01) |
| ***A45C 13/02*** | (2006.01) |
| ***A45C 3/00*** | (2006.01) |
| ***A45C 3/10*** | (2006.01) |
| ***A45C 3/04*** | (2006.01) |

(52) U.S. Cl.
CPC ..... *A45C 3/06* (2013.01); *A45C 3/10* (2013.01); *A45C 11/20* (2013.01); *A45C 13/02* (2013.01); *B65D 81/3886* (2013.01); *A45C 2013/026* (2013.01); *B65D 2313/02* (2013.01)

(58) Field of Classification Search
CPC ..... B65D 81/3846; B65D 81/3876; B65D 81/3886; B65D 2313/02; F25D 3/00; F25D 3/02; F25D 3/06; F25D 3/08; A45C 3/04; A45C 3/10; A45C 3/001; A45C 13/02; A45C 11/20; A45C 3/06; A45C 2013/026
See application file for complete search history.

(56) References Cited

U.S. PATENT DOCUMENTS

| | | | | |
|---|---|---|---|---|
| 5,454,037 | A * | 9/1995 | Pacella | H04B 15/00 379/451 |
| 6,073,796 | A * | 6/2000 | Mogil | 220/592.17 |
| 6,427,475 | B1 * | 8/2002 | DeFelice et al. | |
| 8,209,995 | B2 | 7/2012 | Kieling et al. | |
| 2004/0065703 | A1 | 4/2004 | Bellucci | |
| 2005/0183446 | A1 * | 8/2005 | Fuchs | A45C 11/20 62/457.7 |
| 2006/0010902 | A1 * | 1/2006 | Trinh | A61F 7/02 62/457.2 |
| 2008/0164265 | A1 * | 7/2008 | Conforti | B65D 81/3823 220/592.2 |
| 2010/0270317 | A1 | 10/2010 | Kieling et al. | |
| 2011/0233219 | A1 * | 9/2011 | Proskey | A47J 41/00 220/592.17 |
| 2012/0255971 | A1 * | 10/2012 | Griffith | A45F 3/02 222/105 |
| 2012/0266628 | A1 | 10/2012 | Kieling | |
| 2013/0206800 | A1 * | 8/2013 | Simonsen | A45F 5/00 224/148.3 |
| 2014/0017453 | A1 * | 1/2014 | Chalve | B32B 15/20 428/182 |

FOREIGN PATENT DOCUMENTS

| | | | |
|---|---|---|---|
| CA | 2758565 | A1 | 10/2010 |
| CN | 102438917 | B | 6/2014 |
| CN | 104003067 | A | 8/2014 |
| EP | 2421772 | B1 | 6/2016 |
| EP | 3095729 | A1 | 11/2016 |
| HK | 1169639 | A1 | 3/2015 |
| JP | 2012524704 | A | 10/2012 |
| JP | 6037829 | B2 | 12/2016 |
| KR | 20120017434 | A | 2/2012 |
| WO | 2010124214 | A2 | 10/2010 |

OTHER PUBLICATIONS

Written Opinion of the International Searching Authority, corresponding to International Application No. PCT/AU2016/000402, dated Feb. 22, 2017 (5 pages).

Drinks Bag Company, published on Mar. 10, 2014, viewed on Internet on Feb. 14, 2017: URL: https://www.youtube.com/watch?v=C_fjbg-lqeE, whole video.

* cited by examiner

INSULATED CARRY BAG

CROSS-REFERENCES TO RELATED APPLICATIONS

This application claims priority to, and the benefit of, International Application No. PCT/AU2016/000402, filed Dec. 16, 2016, entitled "An Insulated Carry Bag," which claims priority to, and the benefit of, Australian Application No. 2015101819 filed Dec. 18, 2015, entitled "An Insulated Carry Bag," the entire contents of which are incorporated herein by reference.

FIELD OF THE INVENTION

This invention relates to carry bags of the type that are typically carried by women that include an insulated interior or compartment.

BACKGROUND OF THE INVENTION

It is quite common when going to restaurants, visiting with friends, or going on picnics etc, to carry food and/or drink to consume at the destination in a bag. Quite often it is desirable to keep the food and/or drink either chilled or warm with respect to ambient temperature conditions surrounding the bag.

There are many insulated carry bags on the market, however these tend to be large and bulky, and do not include the fit and finish of a fashion carry bag of the type typically carried by women. The bags commonly available are very utilitarian in nature.

Another problem relates to the multi-use aspect of insulated bags. Sometimes it is desirable to carry objects that are to be kept warmer than ambient temperature, such as food, and at other times, it is desirable to carry items that need to be kept cooler than ambient temperature, such as when carrying cosmetics, pharmaceuticals or drinks etc. This may be difficult to achieve with a single bag if the bag has just been used to carry a warm item, then it needs to carry items that need to be kept cool.

It is an object of the present invention to provide a carry bag that is fashionable and attractive, particularly to women, that at least mitigates some of the aforementioned problems.

SUMMARY OF THE INVENTION

Accordingly, the present invention is a carry bag including a body, and at least one handle, wherein the body of the bag is hollow, and dimensioned so that it can receive items that are to be kept either cooler or warmer than the ambient temperature surrounding the bag. At least the sidewalls are constructed from a combination of a tough and durable outer layer, that corresponds to the exterior side wall of the body of the bag, and an insulative and pliable foam filling, and a tough and durable heat reflective layer, that corresponds with the interior side wall of the body of the bag, and wherein the foam filing is sandwiched between the outer and interior side walls of the body. At least the body of the bag is sealable by way of suitable primary releasable sealing means, so that the objects placed inside the bag are subsequently completely enveloped by the body of the bag.

Preferably, the body of the bag includes a shock absorbing layer in the base of the body, and the shock absorbing layer mitigates the impact when the bag is placed upon a hard surface, such as a benchtop or the like, and wherein the shock absorbing layer also provides further insulative properties to the interior of the body of the bag.

Preferably, the body of the bag is elongated and is particularly suited for use with a tall bottle, for example a wine bottle, or a bladder with tapping means, and the body includes an aperture at one end that enables a user to manipulate the bottle within the bag so that a suitable portion of the bottle's neck is able to protrude from the body of the bag, through the aperture, without the need to open the primary releasable sealing means, or alternatively, allow the user to manipulate the tapping means of the bladder through the aperture, and when not in use, the aperture includes an insulative flap that keeps the aperture closed.

Preferably, at least the sidewalls of the body include refrigeratable or freezable portions that can either be inserted into corresponding pockets built into the sidewalls of the body, or are permanently incorporated into the sidewalls, and the refrigeratable or freezable portions remain pliable, even at normal domestic freezer temperatures.

Preferably, the body of the bag includes a separate inner bag that is removable by a user of the bag, and the inner bag includes a heat reflective inner wall, and an outer wall, and in the inner bag includes a freezable, or refrigeratable, filling that is sandwiched between the inner bag's inner and outer walls, and wherein the bag remains pliable, even at the freezing temperatures reached by normal domestic freezers. One particular bag body may be associated with a plurality of inner bags, any one of which may be used with the body at any one time.

Preferably, the separate inner bag includes an aperture that is adapted to enable a user to manipulate the opening of an object, such as the pouring end of a bottle, or the tap of a beverage bladder, to protrude through the inner bag aperture, and when the inner bag is placed within the body of the bag, the inner bag aperture, and any object protruding through it is adapted to align with the corresponding aperture in the body of the bag so that the contents of the object are accessible from the body of the bag without a need to open the primary releasable sealing means.

Preferably, the separate inner bag includes releasable sealing means so that the inner bag can substantially close around the entire object, except the portion protruding through the aperture, and when the inner bag is properly placed within the body of the bag, the releasable sealing means of the inner bag aligns with the primary releasable sealing means of the body of the bag.

Preferably, the primary releasable sealing means and the inner bag releasable sealing means are zippers, and when the inner bag is properly placed within the body of the bag, the respective zippers of the inner bag and the body of the bag may be interconnected, so that both zippers may be operated simultaneously by the opening and closing of the primary releasable sealing means.

Preferably, the aperture in the body of the bag includes covering means that significantly conceal the presence of the aperture when the contents of the object are not being accessed.

In another form of the present invention, the body of the bag includes a separate inner bag that is removable by a user of the bag, and the inner bag includes a heat reflective inner wall, and an outer wall, and in the inner bag includes a thermally insulative filling that combines with the heat reflective inner wall to provide substantial heat insulation properties to the cavity within the inner bag so that any heated object placed within the inner bag remains at an elevated temperature for a significant period of time, when compared to the ambient temperature surrounding the body of the bag. Any one of a plurality of thermally insulative inner bags can be used with the body at any one time.

Preferably, the thermally insulative filling further includes thermal retention material that is suitable for retaining the heat energy it absorbs for an extended period of time.

Preferably, the inner bag is microwavable in order to provide heat energy to the thermal retention material.

BRIEF DESCRIPTION OF THE DRAWINGS

In order that the invention may be more fully understood, there will now be described, by way of example only, preferred embodiments and other elements of the invention with reference to the accompanying drawings where.

DESCRIPTION OF EXAMPLES OF THE INVENTION AND THE PREFERRED EMBODIMENT

Figure 1:
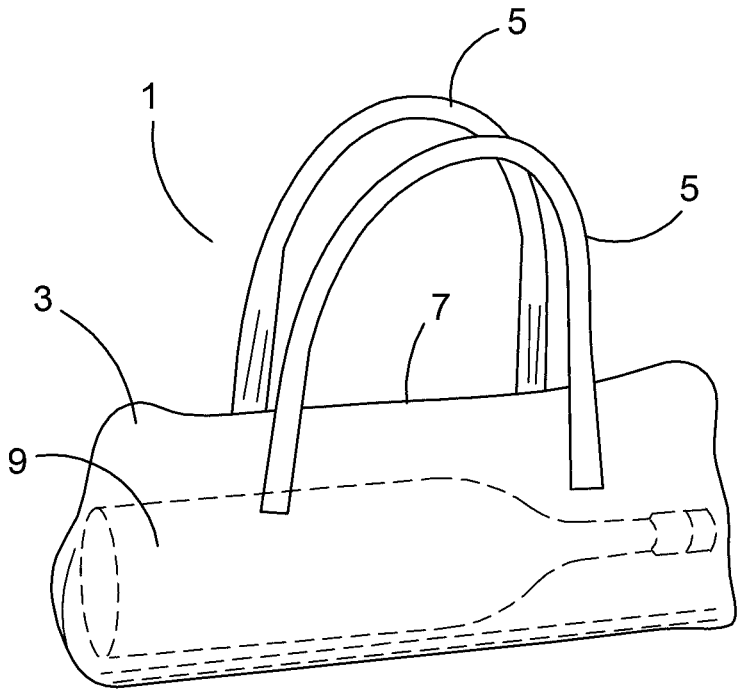
FIG. 1 is an isometric side view of the present invention showing typical contents for the bag in dashed lines.

Turning firstly to FIG. 1, we can see a compact carry bag 1 that includes a body 3 and a pair of handles 5. The body in this example is elongated, and includes a releasable fastening means 7 along the top of the body. In this form of the invention, the bag is suitable for carrying a bottle of wine 9, shown in hidden detail in the Figure. The bag is constructed so that it looks like a lady's fashion hand bag from the exterior, however at least the sidewalls of the body 3 have insulative properties. Typically, at least the exterior side and end walls of the body are fabricated from a tough, pliable and attractive material, such as faux leather polymer, or real leather. At least the interior side and end walls of the body are fabricated out of a radiant heat reflective material that is both durable, pliable, and waterproof. In this example a durable thermally insulative aluminium foil material is used. A thermally insulative and pliable foam material is sandwiched between the out and inner walls of the body. The interior of the body of the bag thereby creates a zone where cold items, such as a chilled bottle of wine for example, that are placed within the bag, remain cooler than the ambient temperature in the vicinity of the bag, for a longer period than they otherwise would.

The pair of handles 5 are adapted to move apart when not in use so that they do not obstruct the opening of the body 3 of the bag 1 when placing or removing items from the interior of the body 3 of the bag 1.

Figure 2:
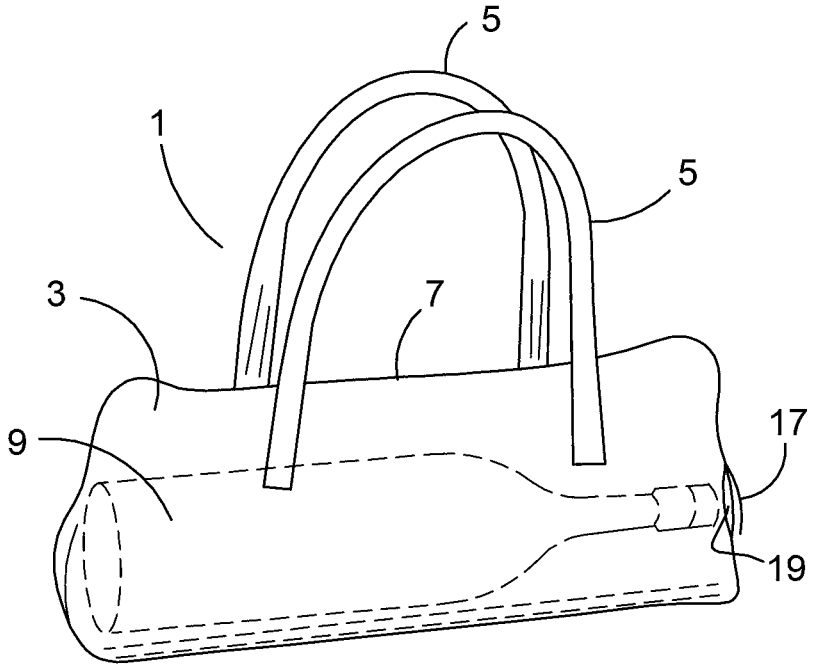
FIGS. 2 and 3 show views of another form of the present invention including an aperture to enable a portion of the neck of a bottle stored within the bag to be extended through the aperture.
Figure 3:
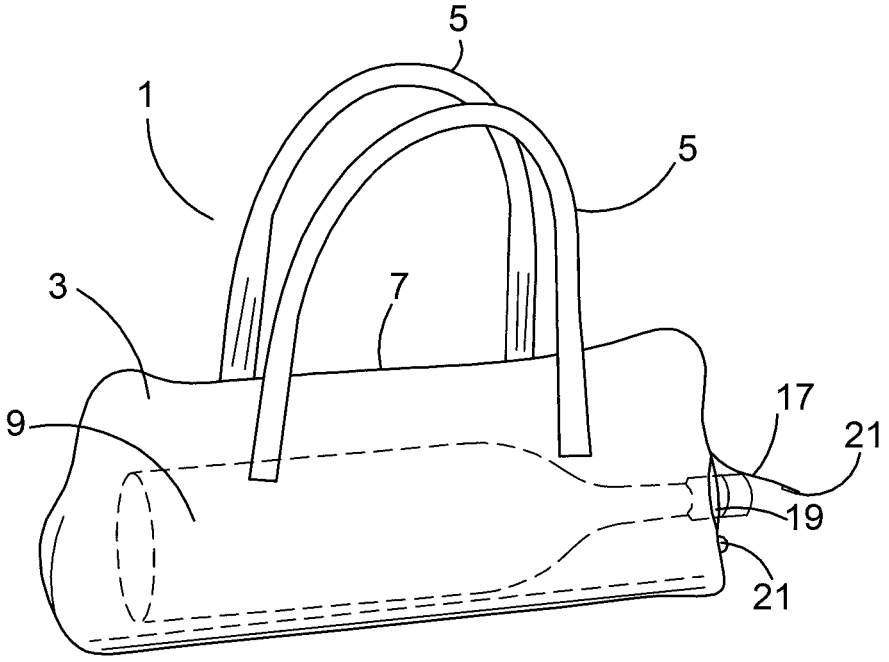

Turning to FIGS. 2 and 3, we are shown another preferred embodiment of the invention where an aperture 19 is included in one end of the body 3 of the bag 1. The aperture 19 is suitably positioned to enable a user of the bag to manipulate the bottle 9 so that a portion of its neck may protrude through the aperture 19. When not in use, the aperture 19 is kept closed by the flap 17. This arrangement enables a user to dispense contents from the bottle 9 without fully opening the body 3 of the bag and exposing the contents of the bag to ambient temperature. The flap 17 may be held in place over the aperture 19 when not in use via a hook loop fastener 21.

Figure 4:
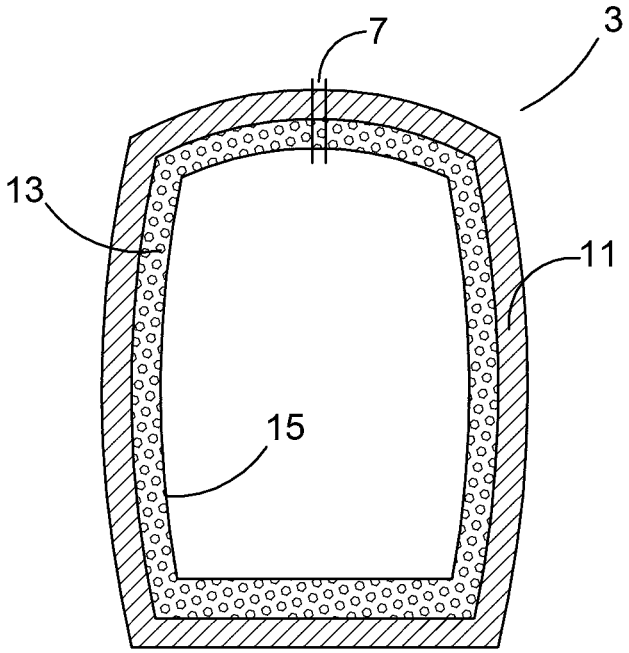
FIG. 4 is a sectional end view of the body used in one form of the present invention.

Turning to FIG. 4, where we are shown one form of the present invention in end sectional view of the body 3 of the bag. This view better illustrates how the bag is constructed. The outer layer 11 is designed to be both tough, pliable and attractive, and is suitable for use on a lady's fashion item. The inner surface 15 comprises a durable thermally insulative aluminium foil, and a suitable thermally insulative foam material is sandwiched between the inner and outer sidewalls 15 and 13 respectively. The releasable fastening means 7 may be any suitable type, but the most common type is a zip fastener.

Figure 5:
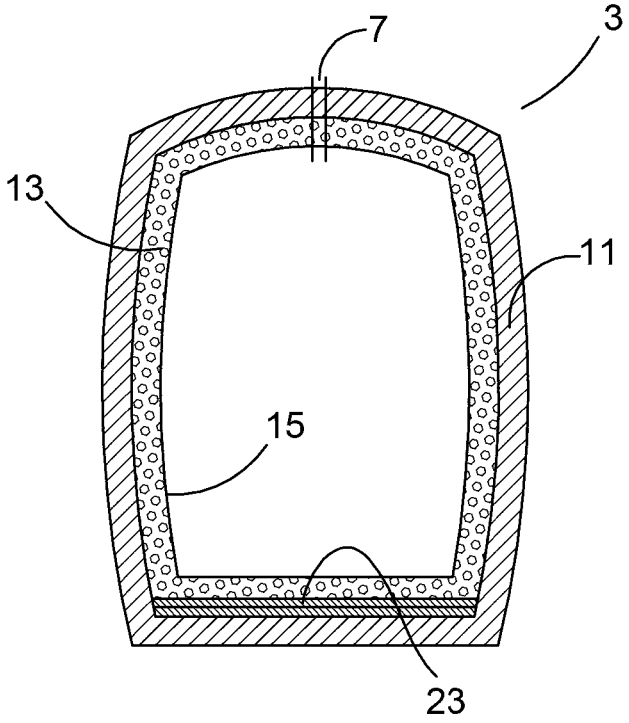
FIG. 5 shows a sectional end view of another form of the present invention where a shock absorbing layer in included in the base of the body of the bag.

Turning to FIG. 5, we are shown another embodiment of the present invention, where a shock absorbing element 23 is included in the base of the body 3. This gives fragile items, such as glass bottles and the like some protection against the shock that may be incurred when the bag is placed down upon a hard object, such as a bench, or table, or the like.

Figure 6:
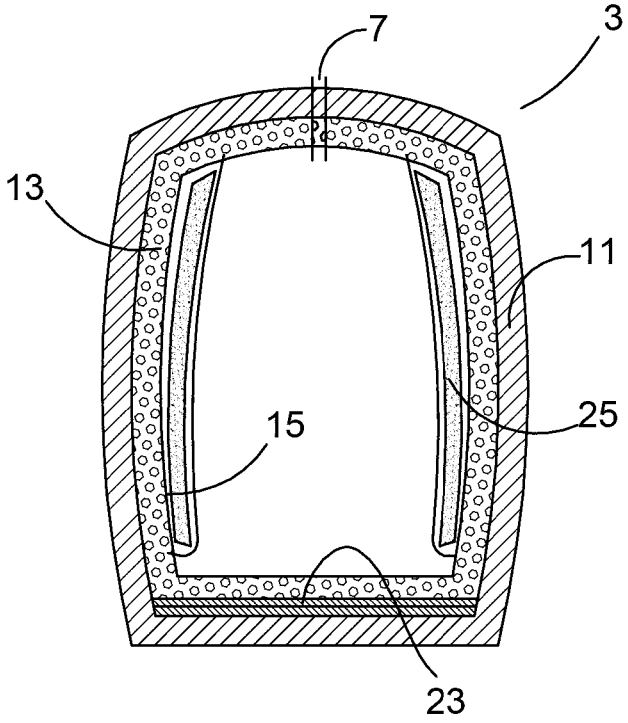
FIG. 6 is a sectional end view of another embodiment of the present invention where refrigeratable or freezable packs are either incorporated into the side walls of the body of the bag, or are insertable into corresponding pockets in the side walls.

Turning to FIG. 6, we are shown another embodiment of the present invention where refrigeratable, or freezable packs 25 are included. These can be pre-frozen, or refrigerated, and then inserted into corresponding pockets within the interior of body 3 of the bag 1, or alternatively, these can be incorporated permanently into the sidewalls. In that arrangement, the entire bag 1 can be stored in the refrigerator or freezer prior to use. The packs 25 have the property of remaining pliable, even when stored for a long time in a typical domestic freezer.

Figure 7:
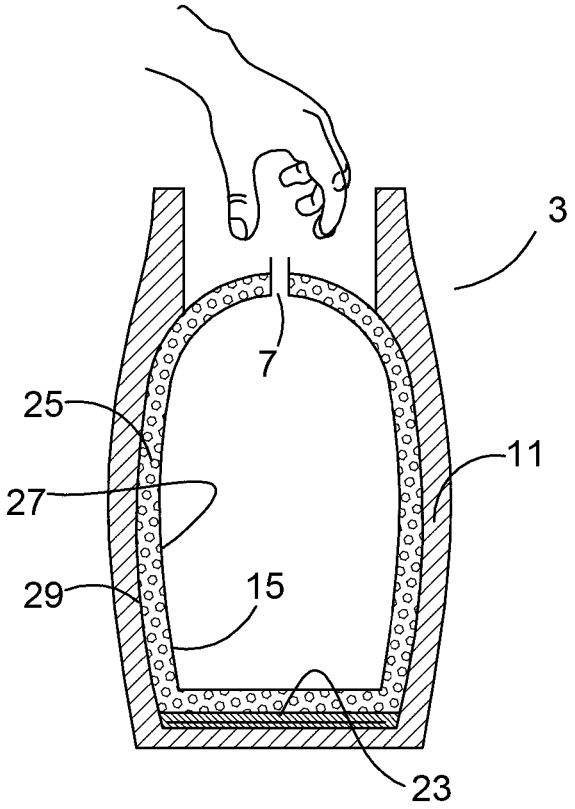
FIGS. 7, 8 and 9 are sectional end views of another embodiment of the present invention.
Figure 8:
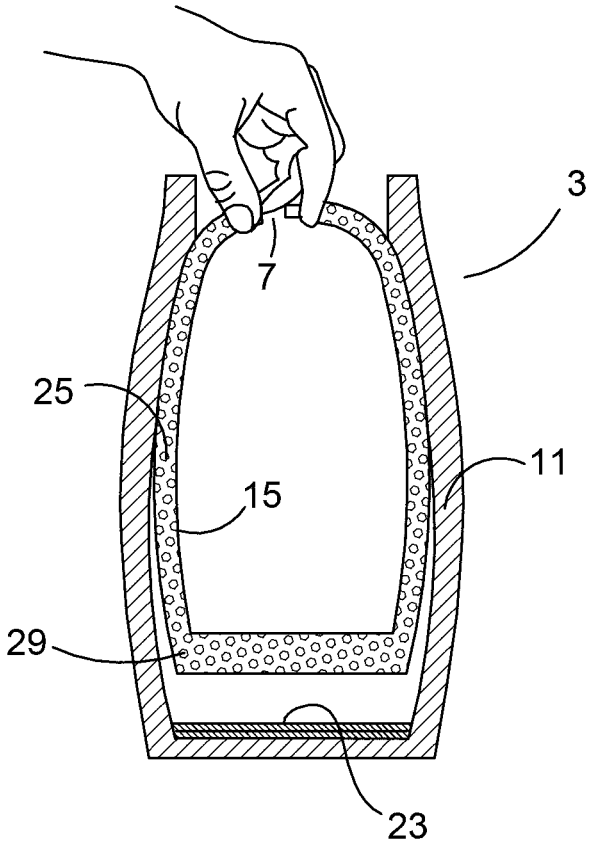
Figure 9:
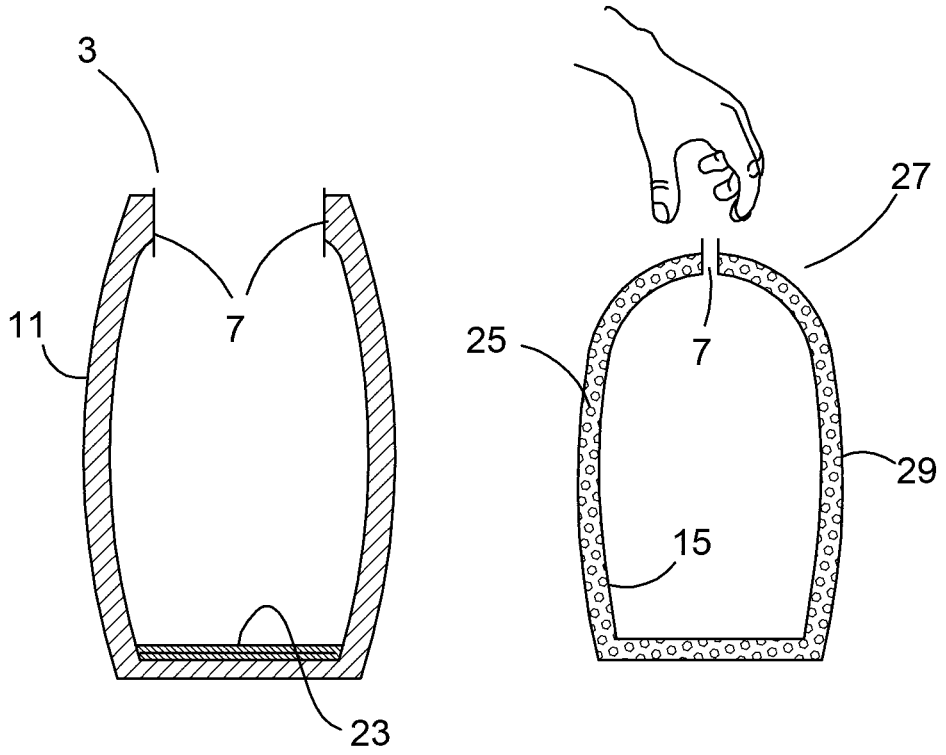

In FIGS. 7 through to 9, we are shown an illustration of yet another embodiment of the present invention. In this embodiment, the body of the bag 3 includes a removable inner bag 27. The inner bag 27 includes a thermally reflective skin that makes the inner wall 15, and optionally, the same material can be used as the inner bag's 27 outer wall 29. A freezer/refrigerator pack 25 is sandwiched between the inner and out walls. Making the inner bag 27 removable, it means that a user can reach inside the outer body 3 and remove the inner bag 27. The bag can then be placed in a refrigerator or freezer prior to use. Several inner bags 25 can be used in association with the outer body 3.

In any of the preferred embodiments, the insulated interior of the bag is washable, and suitable for carrying food, drink, or any other item that needs to be kept hot or cold, like pharmaceuticals, or some women's cosmetics etc.

While the above description includes the preferred embodiments of the invention, it is to be understood that many variations, alterations, modifications and/or additions may be introduced into the constructions and arrangements of parts previously described without departing from the essential features or the spirit or ambit of the invention.

It will be also understood that where the word "comprise", and variations such as "comprises" and "comprising", are used in this specification, unless the context requires otherwise such use is intended to imply the inclusion of a stated feature or features but is not to be taken as excluding the presence of other feature or features.

The reference to any prior art in this specification is not, and should not be taken as, an acknowledgment or any form of suggestion that such prior art forms part of the common general knowledge.

The invention claimed is:

1. A carry bag comprising:

a body having side walls, and at least one handle disposed on the body, wherein the body is hollow and dimensioned to receive one or more objects to be kept either cooler or warmer than an ambient temperature surrounding the body, and wherein the sidewalls of the body are constructed from an outer layer that corresponds to an exterior side wall of the body, a heat reflective layer that corresponds with an interior side wall of the body, and an insulative and pliable foam filling disposed between the outer layer and the heat reflective layer, wherein the body includes a primary releasable seal configured to seal the body so that objects placed inside the bag are completely enveloped by the body, and wherein the body includes a separate inner bag that is removable, the inner bag includes a heat reflective inner wall, an outer wall, and a freezable or refrigeratable filling that is disposed between the inner bag's inner and outer walls.

2. The carry bag as defined in claim 1, wherein the body includes a shock absorbing layer in a base of the body, which mitigates the impact to the body when the bag is placed upon a surface, and wherein the shock absorbing layer also provides insulative properties to the body.

3. The carry bag as defined in claim 1, wherein the body is elongated and configured for use with a bottle or a bladder having a tap, and the body includes an aperture at one end that enables a user to manipulate the bottle or the tap of the bladder through the aperture without the need to open the primary releasable seal.

4. The carry bag as defined in claim 3, wherein the aperture includes an insulative flap that keeps the aperture closed when the aperture is not in use.

5. The carry bag as defined in claim 1, wherein at least the sidewalls of the body include refrigeratable or freezable portions that can either be removably inserted into corresponding pockets built into the sidewalls of the body or are permanently incorporated into the sidewalls.

6. The carry bag as defined in claim 5, wherein the refrigeratable or freezable portions remain pliable even at normal domestic freezer temperatures.

7. The carry bag as defined in claim 1, wherein the separate inner bag includes an aperture that is adapted to enable a user to manipulate the opening of an object disposed in the body, to protrude through the inner bag aperture, and when the inner bag is placed within the body, the inner bag aperture and the object protruding through the inner bag aperture is adapted to align with the corresponding aperture in the body so that the contents of the object are accessible from the body without a need to open the primary releasable seal.

8. The carry bag as defined in claim 7, wherein the separate inner bag includes releasable seal so that the inner bag can substantially close around the object, except the portion protruding through the aperture, and when the inner bag is properly placed within the body, the releasable seal of the inner bag aligns with the primary releasable seal of the body.

9. The carry bag as defined in claim 8, wherein the primary releasable seal and the inner bag releasable seal are zippers, and when the inner bag is properly placed within the body, the respective zippers of the inner bag and the body may be interconnected, so that both zippers may be operated simultaneously by the opening and closing of the primary releasable seal.

10. The carry bag as defined in claim 9, wherein the aperture in the body includes a cover that significantly conceals the presence of the aperture when the contents of the object are not being accessed.

11. The carry bag as defined in claim 1, wherein the body includes a thermally insulative filling that works with the heat reflective inner wall to provide heat insulation properties to a cavity within the inner bag so that any object placed within the inner bag remains at a cooled or an elevated temperature for a significant period of time when compared to the ambient temperature surrounding the body.

12. The carry bag as defined in claim 11, wherein the thermally insulative filling further includes thermal retention material that is suitable for retaining heat energy for an extended period of time.

13. The carry bag as defined in claim 12, wherein the inner bag is microwavable.

14. The carry bag as defined in claim 11, wherein one or more thermally insulative inner bags can be used with the body at any one time.

15. The carry bag as defined in claim 1, wherein the carry bag remains pliable even at the freezing temperatures reached by normal domestic freezers.

16. The carry bag as defined in claim 1, wherein one or more inner bags can be used with the body at any one time.

* * * * *